US011779975B2

(12) United States Patent
Zheng et al.

(10) Patent No.: US 11,779,975 B2
(45) Date of Patent: Oct. 10, 2023

(54) METHOD OF EMULSION CONCENTRATION OPTIMIZATION FOR COLD CONTINUOUS ROLLING MILL SET

(71) Applicant: BAOSHAN IRON & STEEL CO., LTD., Shanghai (CN)

(72) Inventors: Tao Zheng, Shanghai (CN); Kangjian Wang, Shanghai (CN); Shanqing Li, Shanghai (CN); Jizhe Quan, Shanghai (CN); Peilei Qu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 395 days.

(21) Appl. No.: 17/261,478

(22) PCT Filed: Aug. 16, 2019

(86) PCT No.: PCT/CN2019/101118
§ 371 (c)(1),
(2) Date: Jan. 19, 2021

(87) PCT Pub. No.: WO2020/063187
PCT Pub. Date: Apr. 2, 2020

(65) Prior Publication Data

US 2021/0299721 A1 Sep. 30, 2021

(30) Foreign Application Priority Data

Sep. 29, 2018 (CN) ..... 201811144978.X

(51) Int. Cl.
*B21B 27/10* (2006.01)
*B21B 37/00* (2006.01)
(Continued)

(52) U.S. Cl.
CPC ..... *B21B 37/62* (2013.01); *B21B 27/10* (2013.01); *B21B 37/007* (2013.01);
(Continued)

(58) Field of Classification Search
CPC ..... B21B 37/007; B21B 27/10; B21B 45/0239–0266
See application file for complete search history.

(56) References Cited

U.S. PATENT DOCUMENTS 4,315,421 A * 2/1982 Wilson ..... G05D 21/02 72/236

FOREIGN PATENT DOCUMENTS

CN 103544340 A 1/2014
CN 104289527 A 1/2015
(Continued)

OTHER PUBLICATIONS

International Search Report dated Nov. 15, 2019 for PCT Patent Application No. PCT/CN2019/101118.
(Continued)

*Primary Examiner* — Bobby Yeonjin Kim
(74) *Attorney, Agent, or Firm* — Lei Fang, Esq.; Smith Tempel Blaha LLC

(57) ABSTRACT

Disclosed is a method of emulsion concentration optimization for a cold continuous rolling mill set for achieving vibration suppression, the method comprising: defining the process parameters involved in the process of emulsion concentration optimization; setting an initial set value of an emulsion concentration comprehensive optimization target function for a cold continuous rolling mill set for achieving vibration suppression; calculating a bite angle of each stand; calculating a vibration determination index reference value of each stand; setting the emulsion concentration of each stand; calculating the outlet temperature of a strip steel of each stand; calculating the dynamic viscosity of an emulsion in a roll gap of each stand; calculating the oil film thickness in the roll gap of each stand; calculating the emulsion concentration comprehensive optimization target function; determining whether the inequation $F(X)<F_0$ is established;
(Continued)

determining whether the concentration of the emulsion exceeds a feasible region range, and outputting the optimal emulsion concentration set value.

10 Claims, 3 Drawing Sheets

(51) Int. Cl.
*B21B 45/02* (2006.01)
*B21B 37/62* (2006.01)
*B21B 1/22* (2006.01)

(52) U.S. Cl.
CPC ..... *B21B 45/0251* (2013.01); *B21B 45/0266* (2013.01); *B21B 2001/221* (2013.01); *B21B 2037/002* (2013.01); *B21B 2261/20* (2013.01)

(56) References Cited

FOREIGN PATENT DOCUMENTS

CN 107520253 A 12/2017
JP H05169103 A 7/1993
JP 2011051001 A 3/2011

OTHER PUBLICATIONS

Written Opinion dated Nov. 15, 2019 for PCT Patent Application No. PCT/CN2019/101118.
Remn-Min Guo et al.: "Analysis of Chatter Wibration Phenomena of Rolling Mills Using Finite Element Method", Aise Steel Technology, AISE, Pittsburg, PA, US. vol. 70, No. 1, pp. 29-39, XP000336823, ISSN: 0021-1559; Table II; p. 38.
EP Extended Search Report dated Apr. 8, 2021 for App No. 19865518.5.
JP 1st Office Action (original and translation).
JP Grant Decision.
CN 1st OA (original and translation).
CN 2nd OA (original and translation).
CN 3rd OA (original and translation).
CN 1st Search report & Supplemental Search Report.
CN Grant Notification (original and translation).

* cited by examiner

METHOD OF EMULSION CONCENTRATION OPTIMIZATION FOR COLD CONTINUOUS ROLLING MILL SET

CROSS-REFERENCE TO RELATED APPLICATIONS

This application is a 371 U.S. National Phase of PCT International Application No. PCT/CN2019/101118 filed on Aug. 16, 2019, which claims benefit and priority to Chinese patent application no. 201811144978.X filed on Sep. 29, 2018, contents of both are incorporated by reference herein in their entireties.

TECHNICAL FIELD

The present invention belongs to the field of cold continuous rolling, and in particular relates to a method of emulsion concentration optimization for a cold continuous rolling mill set for achieving vibration suppression.

BACKGROUND

As an important process parameter in the process lubrication system, emulsion concentration plays a vital role in the lubrication status of the roll gap of each stand of the cold continuous rolling mill set.

At the same time, the lubrication status of the roll gap directly affects the occurrence of vibration defects of the rolling mill.

If the roll gap is in an over-lubricated status, the friction coefficient is too small, which is likely to cause slip in the rolling process and leads to self-excited vibration of the rolling mill. If the roll gap is in an under-lubricated status, the average oil film thickness in the roll gap is less than the required minimum value, which is likely to cause the oil film in the roll gap to crack during the rolling process and leads to the sharp increase of the friction coefficient, thus changing the rolling pressure, causing the periodic fluctuation of the system stiffness and causing the self-excited vibration of the rolling mill as well.

In the past, the site generally relies on the speed of the rolling mill to suppress the occurrence of vibration defects, but this operation restricts the improvement of the production efficiency of the cold continuous rolling mill set and seriously affects the economic benefits of the enterprise.

The Chinese invention patent with the authorized announcement number of CN 103544340 B and the authorized announcement date of Mar. 2, 2016 discloses a "Method for Setting Emulsion Concentration in Extremely Thin Strip Rolling of Five-stand Cold Continuous Rolling Mill Set". The method for setting emulsion concentration includes the following steps executed by a computer: 1) acquiring the main equipment of the mill set, the characteristics of the strip to be rolled, the main rolling process and the process lubrication system parameters; 2) defining relevant process parameters; 3) calculating the roll bending force and roll shifting amount; 4) assigning values to relevant search process parameters; 5) calculating concentration process parameters; 6) calculating the search process speed of the maximum rolling speed; 7) calculating the friction coefficient of each stand under the current conditions; 8) calculating the rolling force, rolling power, slip factor, thermal slip injury index and vibration coefficient of each stand under the current conditions; 9) calculating the thermal crown of the work roll of each stand; 10) calculating the outlet plate shape and the forced-contact width; and 11) obtaining and outputting the optimum proportion concentration. It can be seen that the patent aims at improving the rolling speed, ensuring the rolling efficiency, and avoiding slipping, thermal slip injury and vibration, so as to ensure the outlet plate shape of the final stand and the minimum forced-contact width at the work roll end.

Through research, it is found that under the premise of determining the process parameters such as rolling schedule, roll process, emulsion flow rate and initial temperature, the setting of emulsion concentration directly determines the lubrication status of the roll gap of each stand of the cold continuous rolling mill set, and can be used as the main process control means to suppress the vibration of the rolling mill.

However, at present, there has not been a report providing the technical solution of suppressing the vibration of the rolling mill by changing the previous mode of constant concentration control of an emulsion in each stand and taking the concentration of the emulsion in each stand as a variable to be optimized.

SUMMARY

The technical problem to be solved by the invention is to provide a method of emulsion concentration optimization for a cold continuous rolling mill set for achieving vibration suppression. The method changes the previous mode of constant concentration control of the emulsion in each stand, takes the concentration of the emulsion in each stand as a variable to be optimized, and carries out comprehensive optimization control on emulsion concentration. The lubrication status of roll gaps in each stand is optimized through the reasonable proportion of emulsion concentration in each stand, thus achieving the purposes of suppressing vibration of the rolling mill, improving product quality and production efficiency, and bringing economic benefits to enterprises.

The technical solution of the invention is to provide a method of emulsion concentration optimization for a cold continuous rolling mill set for achieving vibration suppression, wherein the method includes the following steps:

(a) acquiring apparatus characteristic parameters of a cold continuous rolling mill set;

(b) acquiring critical rolling process parameters of a strip material;

(c) acquiring process parameters involved in the process of emulsion concentration optimization;

(d) setting an initial set value $F_0=1.0\times10^{10}$ of an emulsion concentration comprehensive optimization target function for a cold continuous rolling mill set for achieving vibration suppression;

the executing order of steps (a) to (d) is not limited;

(e) calculating a bite angle $\alpha_i$ of each stand;

(f) calculating a vibration determination index reference value $\xi_{0i}$ of each stand;

(g) setting an emulsion concentration $C_i$ of each stand;

(h) calculating the outlet temperature $T_i$ of a strip steel of each stand;

(i) calculating the dynamic viscosity $\eta_{0i}$ of an emulsion in a roll gap of each stand;

(j) calculating an oil film thickness $\xi_i$ in the roll gap of each stand;

(k) calculating the emulsion concentration comprehensive optimization target function F(X);

(l) determining whether the inequation $F(X)<F_0$, is established, if yes, then setting $C_i^y=C_i$, $F_0=F(X)$ and turning to step (m); if no, directly turning to step (m);

(m) determining whether the emulsion concentration $C_i$ exceeds the range of a feasible region, if yes, turning to step (n); if no, turning to the step (g); wherein the feasible region refers to a region from 0 to the maximum emulsion concentration allowed by an apparatus, and wherein the allowed emulsion concentration of the apparatus is usually within 10%, and 0~10% can be set as the feasible range;

(n) outputting the optimal emulsion concentration set value $C_i^y$, wherein $C_i^y$ is the value of $C_i$ when the calculated value of F(X) is minimum in the feasible region; and (o) adjusting and controlling the emulsion concentration of each stand according to the optimal emulsion concentration set value $C_i^y$ in the step (n) by a control system of the cold continuous rolling mill set.

wherein calculating the vibration determination index reference value $\xi_{0i}$ of each stand in the step (f) comprising the following steps:

(f1) calculating an over-lubricated oil film thickness critical value $\xi_i^+$ of each stand as follows:

it is assumed that when $$\frac{\gamma_i}{\alpha_i} = A^+,$$

the roll gap is just in an over-lubricated status, wherein $\gamma_i$ is a neutral angle of each stand, and $A^+$ is an over-lubricated determining coefficient;

calculating to obtain $$u_i^+ = \frac{1}{2(2A^+ - 1)}\left(\sqrt{\frac{\Delta h_i}{R_i'}} + \frac{T_{i0} - T_{i1}}{P_i}\right)$$

according to $$\alpha_i = \sqrt{\frac{\Delta h_i}{R_i'}},$$

wherein $\Delta h_i$ is the rolling reduction, $\Delta h_i = h_{0i} - h_{1i}$, $h_{0i}$ is the inlet thickness of each stand, $h_{1i}$ is the outlet thickness of each stand, and $R_i'$ is the flattening radius of a work roll of the $i^{th}$ stand, and $$\gamma_i = \frac{1}{2}\sqrt{\frac{\Delta h_i}{R_i'}}\left[1 + \frac{1}{2u_i}\left(\sqrt{\frac{\Delta h_i}{R_i'}} + \frac{T_{i0} - T_{i1}}{P_i}\right)\right]$$

wherein $T_{0i}$ is the back tension of each stand, $T_{1i}$ is the front tension of each stand, and $P_i$ is the rolling pressure of each stand, according to the relationship between the friction coefficient and the oil film thickness: $u_i = a_i + b_i \cdot e^{H_i \cdot \xi_i}$, wherein $a_i$ is the liquid friction influence coefficient, $b_i$ is the dry friction influence coefficient, and $B_i$ is the friction coefficient attenuation index, the over-lubricated oil film thickness critical value $\xi_i^+$ of each stand is calculated by:

$$\xi_i^+ = \frac{1}{B_i}\ln\frac{u_i^+ - a_i}{b_i};$$

(f2) calculating an under-lubricated oil film thickness critical value $\xi_i^-$ of each stand as follows:

it is assumed that when $$\frac{\gamma_i}{\alpha_i} = A^-,$$

the roll gap is just in an under-lubricated status, wherein $A^-$ is the under-lubricated determining coefficient, the following equation can be obtained:

$$u_i^- = \frac{1}{2(2A^- - 1)}\left(\sqrt{\frac{\Delta h_i}{R_i'}} + \frac{T_{i0} - T_{i1}}{P_i}\right);$$

and the under-lubricated oil film thickness critical value $\xi_i^-$ of each stand is calculated by:

$$\xi_i^- = \frac{1}{B_i}\ln\frac{u_i^- - a_i}{b_i};$$

and (f3) calculating the vibration determination index reference value $\xi_{0i}$ of each stand as follows:

$$\xi_{0i} = \frac{\xi_i^+ + \xi_i^-}{2}.$$

wherein calculating the outlet temperature $T_i$ of the strip steel of each stand in the step (h) comprising the following steps:

(h1) calculating the outlet temperature $T_1$ of the first stand:

$$T_1 = T_1^{Inlet} + \frac{1 - (\varepsilon_1/4)}{1 - (\varepsilon_1/2)} \cdot \frac{K_1 \ln\left(\frac{1}{1 - \varepsilon_1}\right)}{pSJ},$$

wherein $T_1^{Inlet}$ is the inlet temperature of each stand, $$\varepsilon_i = \frac{\Delta h_i}{h_{0i}},$$

$\Delta h_i = h_{0i} - h_{1i}$, $h_{0i}$ is the inlet thickness of each stand, $h_{1i}$ is the outlet thickness of each stand, $\rho$ is the density of strip steel, S is the specific heat capacity of strip steel, J is the mechanical equivalent of heat, and $K_i$ is the resistance to deformation of the strip steel of each stand;

(h2) setting i to 1;

(h3) setting the temperature of the first section of strip steel behind the outlet of the $i^{th}$ stand to $T_{i,1}$, i.e., $T_{i,1} = T_i$;

(h4) setting j to 2;

(h5) the relationship between the temperature of the $j^{th}$ section and the temperature of the $j-1^{th}$ section satisfies the following equation:

$$T_{i,j} = -\frac{2k_0 w^{0.264}\exp(9.45 - 0.1918C_i) \times 1.163l}{v_{1i}h_{1i}\rho Sm} T_{i,j-1}^{-0.213}(T_{i,j-1} - T_c) + T_{i,j-1},$$

wherein $k_0$ is the influence coefficient of nozzle shape and spraying angle, $0.8<k_{=0}<1.2$, w is the flow rate of the emulsion, l is the distance between stands, and the distance l between stands is equally divided into m sections, the temperature in the section is represented by $T_{i,j}$, $v_{1i}$ is the outlet speed of each stand, $h_{1i}$ is the outlet thickness of each stand, ρ is the density of the strip steel, S is the specific heat capacity of the strip steel, $T_i$ is the outlet temperature of each stand, and $T_c$ is the temperature of the emulsion;

(h6) determining whether the inequation j<m is established, if yes, then setting j=j+1 and turning to the step (h5); if no, turning to step (h7);

(h7) obtaining the temperature $T_{i,m}$ of the $m^{th}$ section via iterative calculation;

(h8) calculating the inlet temperature $T_{i+1}^{Inlet}$ of the $i+1^{th}$ stand:

$$T_{i+1}^{Inlet}=T_{i,m};$$

(h9) calculating the outlet temperature $T_{i+1}$ of the i+1' stand;

$$T_{i+1}=T_{i+1}^{Inlet}+\frac{1-(\varepsilon_{i+1}/4)}{1-(\varepsilon_{i+1}/2)}\cdot\frac{K_{i+1}\ln\left(\frac{1}{1-\varepsilon_{i+1}}\right)}{\rho SJ};$$

(h10) determining whether the inequation i<n is established, if yes, setting i=i+1 and turning to the step (h3); if no, turning to step (h11); and (h11) obtaining the outlet temperature $T_i$ of each stand.

Specifically, apparatus characteristic parameters of the cold continuous rolling mill set at least include:

the radius $R_i$ of a work roll of each stand; the surface linear speed $v_{ri}$ of a roll of each stand; the original roughness $Ra_{ir0}$ of a work roll of each stand; the roughness attenuation coefficient $B_L$, of a work roll; the distance l between stands; and rolling kilometers $L_i$ of a work roll of each stand after roll change; wherein i=1, 2, . . . , n; i represents the ordinal number of the stand of the cold continuous rolling mill set, and n is the total number of the stands.

Specifically, the critical rolling process parameters of the strip material at least include:

the inlet thickness $h_{0i}$ of each stand; the outlet thickness $h_{1i}$ of each stand; the width B of the strip steel; the inlet speed $v_{0i}$ of each stand; the outlet speed $v_{1i}$ of each stand; the inlet temperature $T_1^{Inlet}$; the resistance to deformation $K_i$ of the strip steel of each stand; the rolling pressure $P_i$ of each stand; the back tension $T_{0i}$ of each stand; the front tension $T_{11}$ of each stand; the concentration influence coefficient $k_c$ of the emulsion; the viscosity compression coefficient θ of a lubricant; the density ρ of the strip steel; the specific heat capacity S of the strip steel; the flow rate w of the emulsion; the temperature $T_c$ of the emulsion; and the mechanical equivalent of heat J.

Specifically, the process parameters involved in the process of emulsion concentration optimization at least include: the over-lubricated oil film thickness critical value $\xi_i^+$ and the corresponding friction coefficient $u_i^+$ of each stand; the under-lubricated oil film thickness critical value $\xi_i^-$ and the corresponding friction coefficient $u_i^-$ of each stand; the vibration determination index reference value $\xi_{0i}$; the rolling reduction $\Delta h_i=h_{0i}-h_{1i}$; the rolling reduction ratio $$\varepsilon_i=\frac{\Delta h_i}{h_{0i}};$$

the inlet temperature $T_i^{Inlet}$ of each stand; and the outlet temperature $T_i$ of each stand; the distance l between stands, which is equally divided into m sections, the temperature in the section represented by $T_{i,j}$, wherein $1\le j\le m$ and $T_i^{Inlet}=T_{i-1,m}$; the over-lubricated determining coefficient $A^+$; and the under-lubricated determining coefficient $A^-$.

Further, the calculation formula for calculating the bite angle $\alpha_i$ of each stand is as follows:

$$\alpha_i=\sqrt{\frac{\Delta h_i}{R_i'}}$$

wherein $R_i'$ is the flattening radius of the work roll of the $i^{th}$ stand, and is a process value in rolling pressure calculation.

Further, the calculation formula for calculating the dynamic viscosity $\eta_{0i}$ of the emulsion in the roll gap of each stand is as follows:

$$\eta_{0i}=b\cdot\exp(-a\cdot T_i)$$

wherein a and b are dynamic viscosity parameters of the lubricant under atmospheric pressure.

Further, the calculation formula for calculating the oil film thickness $\xi_i$ in the roll gap of each stand is as follows:

$$\xi_i=\frac{h_{0i}+h_{1i}}{2h_{0i}}\cdot k_c\cdot\frac{3\theta\eta_{0i}(v_{ri}+v_{0i})}{\alpha_i\left[1-e^{-\theta\left(K_i-\frac{T_{0i}}{h_{0i}\cdot B}\right)}\right]}-k_{rg}\cdot(1+K_{rs})\cdot Ra_{ir0}\cdot e^{-B_{Li}\cdot L_i},$$

wherein $h_{0i}$ is the inlet thickness of each stand, $h_{1i}$ is the outlet thickness of each stand, $k_c$ is the emulsion concentration influence coefficient, θ is the viscosity compression coefficient of the lubricant, $K_i$ is the resistance to deformation of the strip steel of each stand, $\eta_{0i}$ is the dynamic viscosity of the emulsion in the roll gap of each stand, $v_{0i}$ is the inlet speed of each stand, $v_{ri}$ is the surface linear speed of a roll of each stand, $T_{0i}$ is the back tension of each stand, B is the width of the strip steel, $k_{rg}$ represents the coefficient of the strength of the surface longitudinal roughness of the work roll and the strip steel to entrain the lubricant, the value of which is from 0.09 to 0.15, $K_{rs}$ represents the impression rate, i.e., the ratio of transmitting surface roughness of the work roll to the strip steel, the value of which is from 0.2 to 0.6, $Ra_{ir0}$ is the original roughness of a work roll of each stand, $B_L$ is the roughness attenuation coefficient of the work roll, and $L_i$ is the rolling kilometers of a work roll of each stand after roll change.

Further, the emulsion concentration comprehensive optimization target function is calculated according to the following formula:

$$\begin{cases}F(X)=\frac{\lambda}{n}\sum_{i=1}^{n}\sqrt{(\xi_i-\xi_{0i})^2}+(1-\lambda)\max|\zeta_i-\xi_{0i}|\\ \xi_i^-<\xi_i<\xi_i^+\end{cases},$$

wherein $x=\{C_i\}$ is an optimized variable, and λ is a distribution coefficient.

In the disclosure, as long as the execution of the next step is not conditional on the result of the previous step, it is not necessary to proceed according to the above order, unless the execution of the next step depends on the previous step.

Compared with the prior art, the invention has the following advantages:

1. The lubricated status of roll gaps in each stand is optimized through reasonable proportion of the emulsion concentration of each stand, thus achieving the purposes of suppressing vibration of the rolling mill, and improving product quality and production efficiency.

2. As a result of a large number of field tests and theoretical research, based on the apparatus characteristics and rolling process features of the cold continuous rolling mill set, a method of emulsion concentration optimization for a cold continuous rolling mill set for achieving vibration suppression is put forward. The method realizes the optimal ratio of emulsion concentration for each stand of the cold continuous rolling mill set, achieves suppressing vibration of the rolling mill and improving product quality and production efficiency, and brings great economic benefits to enterprises.

DETAILED DESCRIPTION

The invention will be further described below in conjunction with the accompany drawings and embodiments.

In order to further explain the application process of the related technologies mentioned in the invention, a 1730 cold continuous rolling mill set of a cold rolling plant is taken as an example. The application process of the method of emulsion concentration optimization for a cold continuous rolling mill set for achieving vibration suppression is described in detail.

Figure 1:
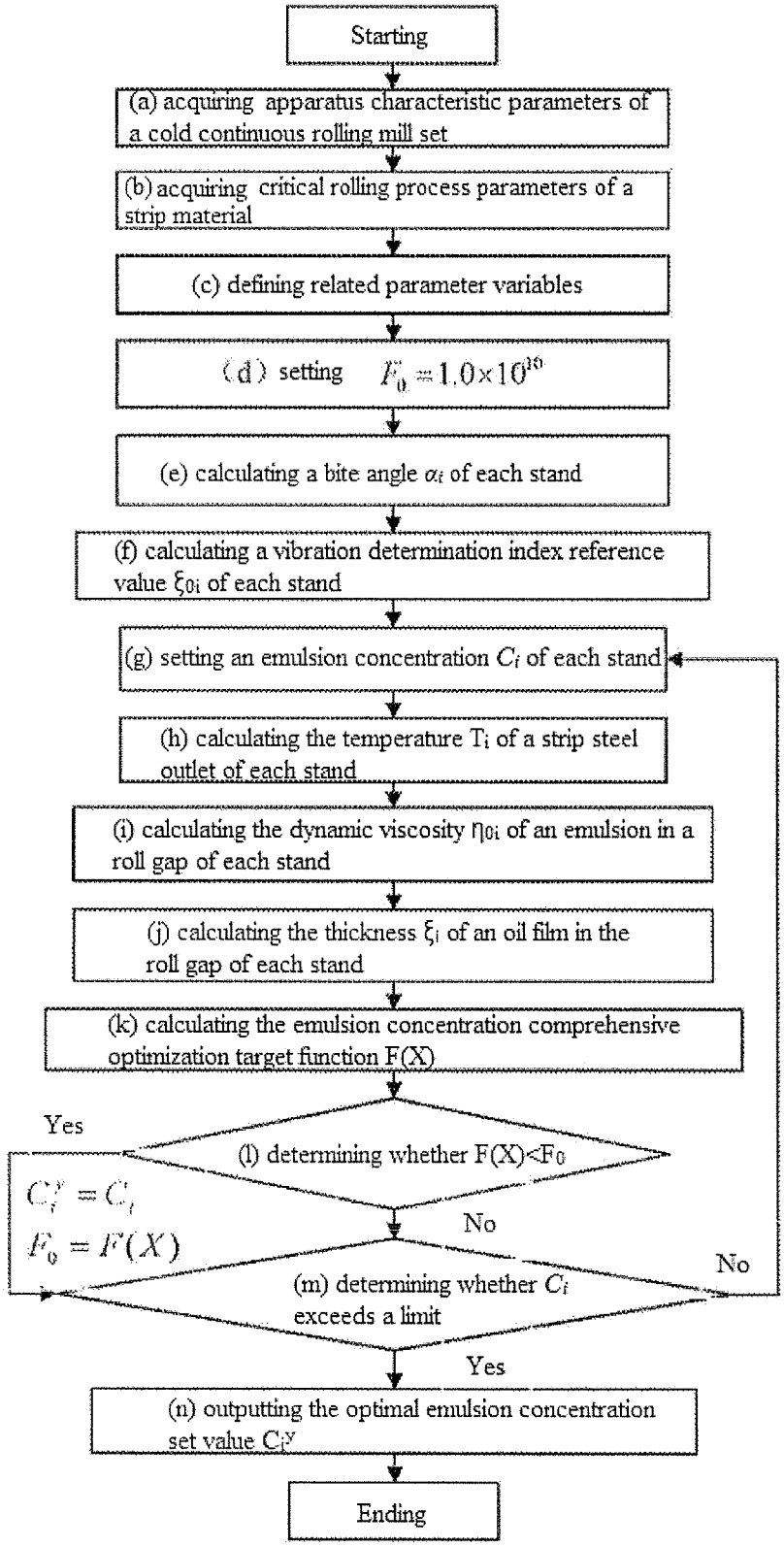
FIG. 1 is a schematic flow diagram of the general technical solutions according to the present invention.

At first, according to the various steps shown in FIG. 1, the relevant parameters are determined in turn. Then the parameters are substituted into corresponding formulas for calculation, and the desired optimal emulsion concentration set value $C_i^y$ is determined or obtained. Finally, the emulsion concentration of each stand is controlled according to the determined optimal emulsion concentration set value, and the comprehensive optimization control is carried out to achieve suppressing the vibration of the rolling mill.

Figure 2:
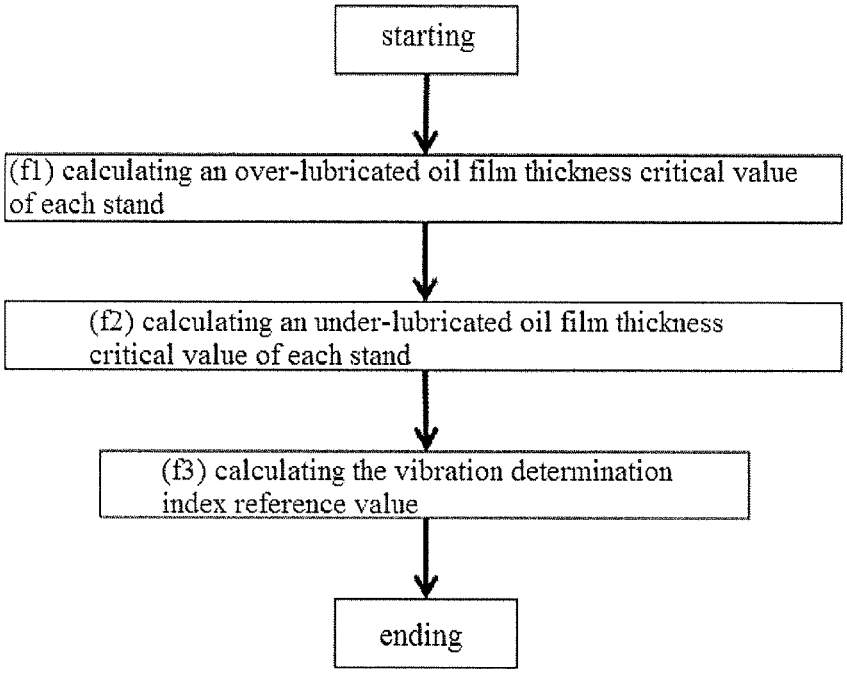
FIG. 2 is a schematic diagram of the calculation process of the reference value of the vibration determination index according to the present invention.

Specifically, in the step (a), the acquired apparatus characteristic parameters of a cold continuous rolling mill set mainly include:

the radius of a work roll of each stand: $R_i$={210, 212, 230, 230, 228} mm;

the surface linear speed of a roll of each stand: $v_{ri}$={180, 320, 500, 800, 1150} m/min;

the original roughness of a work roll of each stand: $Ra_{i,0}$={1.0, 1.0, 0.8, 0.8, 1.0} um;

the roughness attenuation coefficient of the work roll: $B_L$=0.01;

the distance between stands: l=2700 mm; and the rolling kilometers of a work roll of each stand after roll change: $L_i$={100, 110, 230, 180, 90} km; wherein i=1, 2, . . . , n; i represents the ordinal number of the stand of the cold continuous rolling mill set; and n=5, which is the total number of the stands, the same below;

subsequently, in the step (b), the acquired critical rolling process parameters of the strip material mainly include:

the inlet thickness of each stand: $h_{0i}$={2.0, 1.14, 0.63, 0.43, 0.28} mm;

the outlet thickness of each stand: $h_{1i}$={1.14, 0.63, 0.43, 0.28, 0.18} mm;

the width of the strip steel: B=966 mm;

the inlet speed of each stand: $v_{0i}$={110, 190, 342, 552, 848} m/min;

the outlet speed of each stand: $v_{1i}$={190, 342, 552, 848, 1214} m/min;

the inlet temperature: $T_1^{Inlet}$=10° C.;

the resistance to deformation of the strip steel of each stand:

$K_i$={36, 40, 480, 590, 650} MPa;

the rolling pressure of each stand: $P_i$={12800, 11300, 10500, 9600, 8800} kN;

the back tension of each stand: $T_{0i}$={70, 145, 208, 202, 229} MPa;

the front tension of each stand: $T_{1i}$={145, 208, 202, 229, 56} MPa;

the concentration influence coefficient of the emulsion: $k_c$=0.9;

the viscosity compression coefficient of the lubricant: θ=0.034;

the density of the strip steel: ρ=7800 kg/m³;

the specific heat capacity of the strip steel: S=0.47 kJ/(kg·° C.);

the flow rate of the emulsion: w=900 m/min;

the temperature of the emulsion: $T_c$=58° C.;

the mechanical equivalent of heat: J=1; and the flattening radius of the work roll of the it stand: $R_i'$={278.2, 279.7, 300.5, 301.6, 295.4};

subsequently, in the step (c), the acquired process parameters involved in the process of emulsion concentration optimization mainly include: the over-lubricated oil film thickness critical value $\xi_i^+$ and the corresponding friction coefficient $u_i^+$ of each stand; the under-lubricated oil film thickness critical value $\xi_i^-$ and the corresponding friction coefficient $u_i^-$ of each stand; the vibration determination index reference value $\xi_{0i}$, the rolling reduction: $\Delta h_i = h_{0i} - h_{1i}$={0.86, 0.51, 0.2, 0.15, 0.1}; the rolling reduction ratio:

$$\varepsilon_i = \frac{\Delta h_i}{h_{0i}} = \{0.43, 0.45, 0.32, 0.35, 0.36\};$$

the inlet temperature $T_i^{Inlet}$ each stand; and the outlet temperature $T_i$ of each stand; the distance l between stands is 2700 mm, which is equally divided into m=30 sections, the temperature in the section is represented by $T_{i,j}$ (wherein $1 \le j \le m$), and $T_i^{Inlet} = T_{i-1,m}$; the over-lubricated determining coefficient $A^+$; and the under-lubricated determining coefficient $A^-$.

subsequently, in the step (d), an initial set value $F_0 = 1.0 \times 10^{10}$ of an emulsion concentration comprehensive optimization target function for a cold continuous rolling mill set for achieving vibration suppression is set;

subsequently, in the step (e), the bite angle $\alpha_i$ of each stand is calculated according to the rolling theory using the calculation formula:

$$\alpha_i = \sqrt{\frac{\Delta h_i}{R_i'}},$$

obtaining $\alpha_i$={0.0556, 0.0427, 0.0258, 0.0223, 0.0184};

subsequently, in the step (f), the vibration determination index reference value $\xi_{0i}$ of each stand is calculated according to the sub-steps shown in the FIG. 2:

(f1) calculating the over-lubricated oil film thickness critical value $\xi_i^+$ of each stand:

it is assumed that when $$\frac{\gamma_i}{\alpha_i} = A^+ = 1,$$

the roll gap is just in an over-lubricated status; according to $$\alpha_i = \sqrt{\frac{\Delta h_i}{R_i'}}$$

and the calculation formula of the neutral angle $\gamma_i$ of each stand, $$u_i^+ = \frac{1}{2(2A^+ - 1)}\left(\sqrt{\frac{\Delta h_i}{R_i'}} + \frac{T_{i0} - T_{i1}}{P_i}\right)$$

is obtained, obtaining $u_i^+$={00248, 0.0186, 0.0132, 0.0136, 0.0191};

according to the relationship between the friction coefficient and the oil film thickness: $u_i=a_i+b_i\cdot e^{B_i\cdot\xi_i}$ (in the embodiment, $a_i$=0.0126, $b_i$=0.1416, and $B_i$=−2.4297), the over-lubricated oil film thickness critical value $\xi_i^+$ of each stand is calculated by the calculation formula:

$$\xi_i^+ = \frac{1}{B_i}\ln\frac{u_i^+ - a_i}{b_i},$$

obtaining $\xi_i^+$={1.009, 1.301, 2249, 2.039, 1.268} um;

(f2) calculating the under-lubricated oil film thickness critical value $\xi_i^+$ of each stand is calculated:

it is assumed that when $$\frac{\gamma_i}{\alpha_i} = A^- = 0.6,$$

the roll gap is just in an under-lubricated status, $$u_i^- = \frac{1}{2(2A^- - 1)}\left(\sqrt{\frac{\Delta h_i}{R_i'}} + \frac{T_{i0} - T_{i1}}{P_i}\right),$$

$u_i^-$={0.1240, 0.0930, 0.0660, 0.0680, 0.0955};

according to the relationship between the friction coefficient and the oil film thickness: $u_i=a_i+b_i\cdot e^{B_i\cdot\xi_i}$, the under-lubricated oil film thickness critical value $\xi_i^-$ of each stand is calculated by the calculation formula $$\xi_i^- = \frac{1}{B_i}\ln\frac{u_i^- - a_i}{b_i},$$

obtaining $\xi_i^-$={0.098, 0.233, 0.401, 0.386, 0.220} um;

subsequently, in the step (f3), the vibration determination index reference value $\xi_{0i}$ is calculated, wherein $$\xi_{0i} = \frac{\xi_i^+ + \xi_i^-}{2},$$

obtaining $\xi_{0i}$={0.554, 0.767, 1.325, 1.213, 0.744};

subsequently, in the step (g), the emulsion concentration of each stand is set as $C_i$={4.2, 4.2, 4.2, 4.2, 4.2} %.

Figure 3:
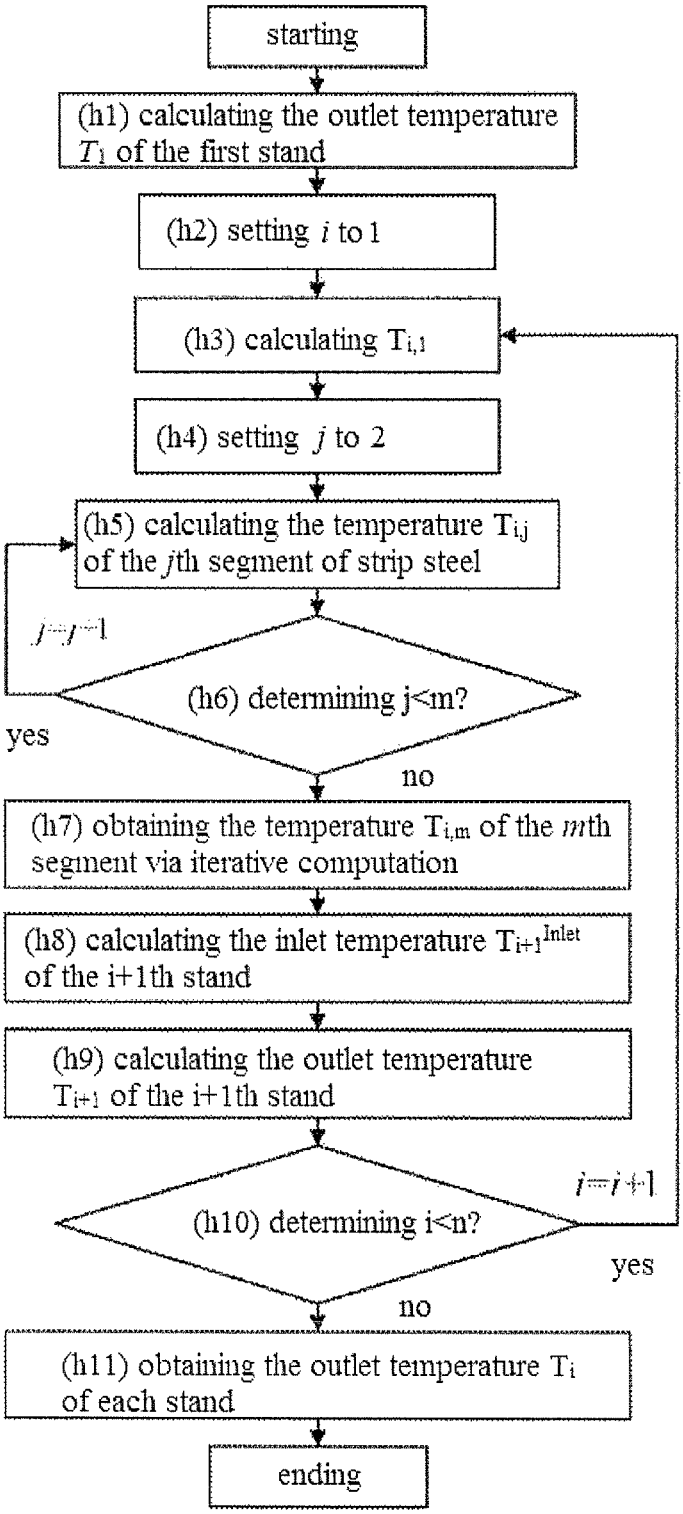
FIG. 3 is a schematic diagram of the calculation process of the strip steel outlet temperature of each stand according to the present invention.

Then, in the step (h), the outlet temperature $T_i$ of the strip steel of each stand is calculated according to the sub-steps shown in the FIG. 3.

Subsequently, in the step (h1), the outlet temperature $T_1$ of the first stand is calculated as follows:

$$T_1 = T_1^{Inlet} + \frac{1-(\varepsilon_1/4)}{1-(\varepsilon_1/2)}\cdot\frac{K_1\ln\left(\frac{1}{1-\varepsilon_1}\right)}{\rho SJ} = 110 + \frac{1-(0.43/4)}{1-(0.43/2)}\cdot\frac{360\ln\left(\frac{1}{1-0.13}\right)}{7.8\cdot 0.47\cdot 1} = 172.76^\circ\text{ C.}$$

Subsequently, in the step (h2), i is set to 1.

Subsequently, in the step (h3), the temperature of the first section of strip steel behind the outlet of the f0 stand is set to $T_{i,\ 1}$, i.e., $T_{i,\ 1}=T_i$=172.76° C.

Subsequently, in the step (h4), j is set to 2.

Subsequently, in the step (h5), the relationship between the temperature of the $j^{th}$ section and the temperature of the $j-1^{th}$ section satisfies the following equation:

$$T_{i,j} = -\frac{2k_0 w^{0.264}\exp(9.45 - 0.1918C_i)\times 1.163l}{v_{1i}h_{1i}\rho Sm}T_{i,j-1}^{-0.213}(T_{i,j-1} - T_c) + T_{i,j-1},$$

wherein $k_0$ is the influence coefficient of the nozzle shape and the spraying angle, and $k_0$=1.

Subsequently, in the step (h6), whether the inequation j<m is established is determined, if yes, then setting j=j+1 and turning to step (h5); if no, turning to step (h7).

Subsequently, in the step (h7), the temperature of the 30th section (when m=30) is obtained via iterative calculation: $T_{1.30}$=103.32° C.

Subsequently, in the step (h8), the inlet temperature $T_2^{Inlet}$ of the second stand is calculated as follows: $T_2^{Inlet}=T_{1,m}$=103.32° C.

Subsequently, in the step (h9), the outlet temperature $T_2$ of the second stand is calculated as follows:

$$T_2 = T_2^{Inlet} + \frac{1-(\varepsilon_2/4)}{1-(\varepsilon_2/2)}\cdot\frac{K_2\ln\left(\frac{1}{1-\varepsilon_2}\right)}{pSJ} = 103.32 + \frac{1-(0.45/4)}{1-(0.45/2)}\cdot\frac{400\ln\left(\frac{1}{1-0.45}\right)}{7800\cdot 0.47\cdot 1} = 178.02^\circ\text{ C.}$$

Subsequently, in the step (h10), whether the inequation i<n is established is determined; if yes, setting i=i+1 and turning to the step (h3); if no, turning to step (h11).

Subsequently, in the step (h11), the outlet temperature of each stand is obtained: $T_i$={17276, 17802, 186.59, 194.35, 206.33}° C.

Subsequently, in the step (i), the dynamic viscosity $\eta_{0i}$ of the emulsion in the roll gap of each stand is calculated by equation: $\eta_{0i}=b\cdot\exp(-a\cdot T_i)$ (in the equation, a and b are dynamic viscosity parameters of the lubricant under the atmospheric pressure, wherein a=0.05, b=2.5), $\eta_{0i}$={5.39, 5.46, 5.59, 5.69, 5.84} is obtained.

Subsequently, in the step (j), the thickness $\xi_i$ of the oil film in the roll gap of each stand is calculated by the following calculation formula:

$$\xi_i = \frac{h_{0i}+h_{1i}}{2h_{0i}}\cdot k_c\cdot\frac{3\theta\eta_{0i}(v_{ri}+v_{0i})}{\alpha_i\left[1-e^{-\theta\left(K_i\frac{T_{0i}}{h_{0i}\cdot B}\right)}\right]} - k_{rg}\cdot(1+K_{rs})\cdot Ra_{ir0}\cdot e^{-B_{Li}\cdot L_i},$$

wherein, $k_{rg}$ represents the coefficient of the strength of the surface longitudinal roughness of the work roll and the strip steel to entrain the lubricant, wherein $k_{rg}$=1.183, $K_{rs}$ represents the impression rate, i.e., the ratio of transmitting surface roughness of the work roll to the strip steel, wherein $K_{rs}$=0.576, and S={0.784, 0.963, 2.101, 2.043, 1.326} um is obtained.

Subsequently, in the step (k), the emulsion concentration comprehensive optimization target function is calculated as follows:

$$\begin{cases} F(X) = \frac{\lambda}{n}\sum_{i=1}^{n}\sqrt{(\xi_i-\xi_{0i})^2} + (1-\lambda)\max|\xi_i-\xi_{0i}| \\ \xi_i^- < \xi_i < \xi_i^+ \end{cases};$$

wherein X={$C_i$} is an optimized variable, and λ=0.5 is a distribution coefficient, and F(X)=0.94 is obtained.

Subsequently, in the step (l), if the equation, $F(X)=0.94<F_0=1\times10^{10}$, is established, then $C_i^y=C_i$={4.2, 4.2, 4.2, 4.2, 4.2} %, $F_0$=F(X)=0.94, and step (m) is performed.

Subsequently, in the step (m), whether the emulsion concentration $C_i$ exceeds the range of the feasible region is determined, if yes, the step (n) is performed; if no, the step (g) is performed.

Subsequently, in the step (n), the optimal emulsion concentration set value $C_i^y$={4.2, 4.2, 4.5, 4.6, 4.3} % is outputted, wherein $C_i^y$ is the value of $C_i$ when the calculated value of F(X) is minimum in the feasible region.

Finally, during the whole rolling process, the control system of the cold continuous rolling mill set adjusts and controls the emulsion concentration of each stand respectively according to the optimal emulsion concentration set value obtained in the step (n).

To sum up, the technical solution of the invention changes the mode in the prior art that the emulsion in each stand adopts constant concentration control, takes the concentration of the emulsion in each stand as a variable to be optimized, and carries out comprehensive optimization control on the emulsion concentration, thus achieving suppressing the vibration of the rolling mill.

The method of the invention can be widely used in the field of controlling emulsion concentration of the cold continuous rolling mill set.

The invention claimed is:

1. A method of emulsion concentration optimization for a cold continuous rolling mill set, comprising the following steps:

(a) acquiring apparatus characteristic parameters of a cold continuous rolling mill set;

(b) acquiring critical rolling process parameters of a strip material;

(c) acquiring process parameters involved in the process of emulsion concentration optimization;

(d) setting an initial set value of an emulsion concentration comprehensive optimization target function for a cold continuous rolling mill set for achieving vibration suppression: $F_0=1.0\times10^{10}$;

the executing order of steps (a) to (d) is not limited;

(e) calculating a bite angle α, of each stand;

(f) calculating a vibration determination index reference value $\xi_{0i}$ of each stand;

(g) setting an emulsion concentration $C_i$ of each stand;

(h) calculating the outlet temperature $T_i$ of a strip steel of each stand;

(i) calculating the dynamic viscosity $\eta_{0i}$ of an emulsion in a roll gap of each stand;

(j) calculating an oil film thickness $\xi_i$ in the roll gap of each stand;

(k) calculating the emulsion concentration comprehensive optimization target function F(X);

(l) determining whether the inequation $F(X)<F_0$ is established, if yes, then setting $C_i^y=C_i$, $F_0$=F(X) and turning to step (m); if no, directly turning to step (m);

(m) determining whether the emulsion concentration $C_i$ exceeds the range of a feasible region, if yes, turning to step (n); if no, turning to step (g), wherein the feasible region refers to a region from 0 to the maximum emulsion concentration allowed by the cold continuous rolling mill set;

(n) outputting the optimal emulsion concentration set value $C_i^y$, wherein $C_i^y$ is the value of $C_i$ when the calculated value of F(X) is minimum in the feasible region; and (o) adjusting and controlling the emulsion concentration of each stand according to the optimal emulsion concentration set value $C_i^y$ in the step (n) by a control system of the cold continuous rolling mill set; and in each formula, i represents the stand ordinal number of the cold continuous rolling mill set.

2. The method of claim 1, wherein calculating the vibration determination index reference value $\xi_{0i}$ of each stand in the step (f) comprising the following steps:

(f1) calculating an over-lubricated oil film thickness critical value $\xi_i^+$ of each stand as follows:

it is assumed that when $$\frac{\gamma_i}{\alpha_i} = A^+,$$

the roll gap is just in an over-lubricated status, wherein $\gamma_i$ is a neutral angle of each stand, and $A^+$ is an over-lubricated determining coefficient;

calculating to obtain $$u_i^+ = \frac{1}{2(2A^+-1)}\left(\sqrt{\frac{\Delta h_i}{R_i'}} + \frac{T_{i0}-T_{i1}}{P_i}\right)$$

according to $$\alpha_i = \sqrt{\frac{\Delta h_i}{R_i'}},$$

wherein $\Delta h_i$ is the rolling reduction, $\Delta h_i = h_{0i} - h_{1i}$, $h_{0i}$ is the inlet thickness of each stand, $h_{1i}$ is the outlet thickness of each stand, and $R_i'$ is the flattening radius of a work roll of the $i^{th}$ stand, and $$\gamma_i = \frac{1}{2}\sqrt{\frac{\Delta h_i}{R_i'}}\left[1 + \frac{1}{2u_i}\left(\sqrt{\frac{\Delta h_i}{R_i'}} + \frac{T_{i0} - T_{i1}}{P_i}\right)\right],$$

wherein $T_{0i}$ is the back tension of each stand, $T_{1i}$ is the front tension of each stand, and $P_i$ is the rolling pressure of each stand;

then calculating to obtain the over-lubricated oil film thickness critical value of each stand $\xi_i^+$ by $$\xi_1^+ = \frac{1}{B_i}\ln\frac{u_i^+ - a_i}{b_i}$$

according to the relationship formula between the friction coefficient and the oil film thickness: $u_i = a_i + b_i \cdot e^{B_i \cdot \xi_i}$, wherein $a_i$ is the liquid friction influence coefficient, $b_i$ is the dry friction influence coefficient, and $B_i$ is the friction coefficient attenuation index;

(f2) calculating an under-lubricated oil film thickness critical value $\xi_i^-$ of each stand as follows:

calculating to obtain $$u_i^- = \frac{1}{2(2A^- - 1)}\left(\sqrt{\frac{\Delta h_i}{R_i'}} + \frac{T_{i0} - T_{i1}}{P_i}\right)$$

assuming that when $$\frac{\gamma_i}{\alpha_i} = A^-,$$

the roll gap is just in an under-lubricated status, wherein $A^-$ is the under-lubricated determining coefficient;

then calculating to obtain the under-lubricated oil film thickness critical value $\xi_i^-$ of each stand by $$\xi_i^- = \frac{1}{B_i}\ln\frac{u_i^- - a_i}{b_i};$$

and (f3) calculating the vibration determination index reference value $\xi_{0i}$ by $$\xi_{0i} = \frac{\xi_i^+ + \xi_i^-}{2}.$$

3. The method of claim 1, wherein calculating the outlet temperature $T_i$ of the strip steel of each stand in the step (h) comprising the following steps:

(h1) calculating the outlet temperature $T_i$ of the first stand:

$$T_1 = T_1^{Inlet} + \frac{1 - (\varepsilon_1/4)}{1 - (\varepsilon_1/2)} \cdot \frac{K_1 \ln\left(\frac{1}{1 - \varepsilon_1}\right)}{\rho SJ},$$

wherein $T_1^{Inlet}$ is the inlet temperature of each stand, $$\varepsilon_i = \frac{\Delta h_i}{h_{0i}},$$

$\Delta h_i = h_{0i} - h_{1i} h_{0i}$ is the inlet thickness of each stand, $h_{1i}$ is the outlet thickness of each stand, $\rho$ is the density of strip steel, S is the specific heat capacity of strip steel, J is the mechanical equivalent of heat, and $K_i$ is the resistance to deformation of the strip steel of each stand;

(h2) setting i to 1;

(h3) setting $T_{i,1}$ the temperature of the first section of strip steel behind the outlet of the $i^{th}$ stand, i.e., $T_{i,1} = T_i$;

(h4) setting j to 2;

(h5) calculating the temperature $T_{i,j}$ of the $j^{th}$ section of strip steel by the relationship between the temperature of the $j^{th}$ section and the temperature of the $j-1^{th}$ section shown by the following equation:

$$T_{i,j} = -\frac{2k_0 w^{0.264}\exp(9.45 - 0.1918C_i) \times 1.163l}{v_{1i}h_{1i}\rho Sm} T_{i,j-1}^{-0.213}(T_{i,j-1} - T_c) + T_{i,j-1},$$

wherein $k_0$ is the influence coefficient of nozzle shape and spraying angle, w is the flow rate of the emulsion, l is a distance between stands, and the distance l between stands is equally divided into m section, the temperature in the section is represented by $T_{i,j}$, $v_{1i}$ is the outlet speed of each stand, $h_{1i}$ is the outlet thickness of each stand, $\rho$ is the density of the strip steel, S is the specific heat capacity of the strip steel, $T_i$ is the outlet temperature of each stand, and $T_c$ is the temperature of the emulsion;

(h6) determining whether the inequation j<m is established, if yes, then setting j=j+1 and turning to the step (h5); if no, turning to step (h7);

(h7) obtaining the temperature $T_{i,m}$ of the $m^{th}$ section via iterative calculation;

(h8) calculating the inlet temperature $T_{i+1}^{Inlet}$ of the $i+1^{th}$ stand:

$$T_{i+1}^{Inlet} = T_{i,m};$$

(h9) calculating the outlet temperature $T_{i+1}^{Inlet}$ of the $i+1^{th}$ stand:

$$T_{i+1} = T_{i+1}^{Inlet} + \frac{1 - (\varepsilon_{i+1}/4)}{1 - (\varepsilon_{i+1}/2)} \cdot \frac{K_{i+1}\ln\left(\frac{1}{1 - \varepsilon_{i+1}}\right)}{\rho SJ};$$

(h10) determining whether the inequation i<n is established, if yes, setting i=i+1 and turning to the step (h3); if no, turning to step (h11); and (h11) obtaining the outlet temperature $T_i$ of each stand.

4. The method of claim 1, wherein the apparatus characteristic parameters of the cold continuous rolling mill set at least comprise:

the radius $R_i$ of a work roll of each stand; the surface linear speed $v_{ri}$ of a roll of each stand; the original roughness $Ra_{ir0}$ of a work roll of each stand; the roughness attenuation coefficient $B_L$ of a work roll; the distance l between stands; and rolling kilometers $L_i$ of a work roll of each stand after roll change; wherein i=1, 2, . . . , n; i represents the ordinal number of the stand of the cold continuous rolling mill set, and n is the total number of the stands.

5. The method of emulsion concentration optimization for the cold continuous rolling mill set as claimed in claim 1, wherein the critical rolling process parameters of the strip material at least comprise:

the inlet thickness $h_{0i}$ of each stand; the outlet thickness $h_{1i}$ of each stand; the width B of the strip steel; the inlet speed $v_{0i}$ of each stand; the outlet speed $v_{1i}$ of each stand; the inlet temperature $T_1^{Inlet}$; the resistance to deformation $K_i$ of the strip steel of each stand; the rolling pressure $P_i$ of each stand; the back tension $T_{0i}$ of each stand; the front tension $T_{1i}$ of each stand; the concentration influence coefficient $k_c$ of the emulsion; the viscosity compression coefficient θ of a lubricant; the density ρ of the strip steel; the specific heat capacity S of the strip steel; the flow rate w of the emulsion; the temperature $T_c$ of the emulsion; and the mechanical equivalent of heat J.

6. The method of claim 1, wherein the process parameters involved in the process of emulsion concentration optimization at least comprise: the over-lubricated oil film thickness critical value $\xi_i^+$ and the corresponding friction coefficient $u_i^+$ of each stand; the under-lubricated oil film thickness critical value $\xi_i^-$ and the corresponding friction coefficient $u_i^-$ of each stand; and the vibration determination index reference value $\xi_{0i}$;

the rolling reduction $\Delta h_i = h_{0i} - h_{1i}$; the rolling reduction ratio $$\varepsilon_i = \frac{\Delta h_i}{h_{0i}};$$

the inlet temperature $T_i^{Inlet}$ and the outlet temperature $T_i$ of each stand;

the distance l between stands, which is equally divided into m section, the temperature in the section represented by $T_{i,j}$, wherein $1 \le j \le m$ and $T_i^{Inlet} = T_{i-1,m}$;

the over-lubricated determining coefficient $A^+$; and the under-lubricated determining coefficient $A^-$.

7. The method of claim 1, wherein the calculation formula for calculating the bite angle $\alpha_i$ of each stand is as follows:

$$\alpha_i = \sqrt{\frac{\Delta h_i}{R_i'}}$$

wherein $R_i'$ is the flattening radius of the work roll of the $i^{th}$ stand, and is a process value in rolling pressure calculation.

8. The method of claim 1, wherein the calculation formula for calculating the dynamic viscosity $\eta_{0i}$ of the emulsion in the roll gap of each stand is as follows:

$$\eta_{0i} = b \cdot \exp(-a \cdot T_i)$$

wherein a and b are dynamic viscosity parameters of the lubricant under atmospheric pressure.

9. The method of claim 1, wherein the calculation formula for calculating the oil film thickness in the roll gap of each stand is as follows:

$$\xi_i = \frac{h_{0i} + h_{1i}}{2h_{0i}} \cdot k_c \cdot \frac{3\theta\eta_{0i}(v_{ri} + v_{0i})}{\alpha_i\left[1 - e^{-\theta\left(K_i \frac{T_{0i}}{h_{0i} \cdot B}\right)}\right]} - k_{rg} \cdot (1 + K_{rs}) \cdot Ra_{ir0} \cdot e^{-B_{Li} \cdot L_i},$$

wherein $h_{0i}$ is the inlet thickness of each stand, $h_{1i}$ is the outlet thickness of each stand, $k_c$ is the emulsion concentration influence coefficient, θ is the viscosity compression coefficient of the lubricant, $K_i$ is the resistance to deformation of the strip steel of each stand, $\eta_{0i}$ is the dynamic viscosity of the emulsion in the roll gap of each stand, $v_{0i}$ is the inlet speed of each stand, $v_{ri}$ is the surface linear speed of a roll of each stand, $T_{0i}$ is the back tension of each stand, B is the width of the strip steel, $k_{rg}$ represents the coefficient of the strength of entrainment of lubricant by the longitudinal surface roughness of the work roll and the strip steel, the value of which is from 0.09 to 0.15, $K_{rs}$ represents the impression rate, i.e., the ratio of transmitting surface roughness of the work roll to the strip steel, $Ra_{ir0}$ is the original roughness of a work roll of each stand, $B_L$ is the roughness attenuation coefficient of the work roll, and $L_i$ is the rolling kilometers of a work roll of each stand after roll change.

10. The method of in claim 1, wherein the emulsion concentration comprehensive optimization target function is calculated according to the following formula:

$$\begin{cases} F(X) = \frac{\lambda}{n}\sum_{i=1}^{n}\sqrt{(\xi_i - \xi_{0i})^2} + (1-\lambda)\max|\xi_i - \zeta_{0i}| \\ \xi_i^- < \xi_i < \xi_i^+ \end{cases},$$

wherein $X = \{C_i\}$ is an optimization variable, and λ is a distribution coefficient.

* * * * *